US005431123A

United States Patent [19]

Johnson

[11] Patent Number: 5,431,123

[45] Date of Patent: Jul. 11, 1995

[54] ANCHORING APPARATUS

[75] Inventor: Sheldon B. Johnson, St. George, Utah

[73] Assignee: BetterWay Technology, Inc., St. George, Utah

[21] Appl. No.: 257,001

[22] Filed: Jun. 8, 1994

[51] Int. Cl.[6] ..... B63B 21/26

[52] U.S. Cl. ..... 114/295; 114/218; 114/199; 24/132 R; 24/133; 24/134 R; 52/155

[58] Field of Search ..... 52/155, 158, 156; 114/294, 295, 297, 218, 293, 199; 24/133, 132 R, 134 R

[56] References Cited

U.S. PATENT DOCUMENTS

| | | | |
|---|---|---|---|
| 2,228,204 | 1/1941 | Dimmock et al. | 114/218 |
| 3,190,253 | 6/1965 | Grimm | 114/218 |
| 4,459,787 | 7/1984 | Wilcox | 52/155 |
| 4,639,978 | 2/1987 | Boden | 24/134 K |
| 4,825,604 | 5/1989 | Manning | 52/158 |
| 4,899,423 | 2/1990 | Randall | 114/218 X |
| 4,960,064 | 10/1990 | Mestas et al. | 114/230 |

FOREIGN PATENT DOCUMENTS

| | | | |
|---|---|---|---|
| 0113277 | 3/1969 | Denmark | 114/294 |
| 0300847 | 8/1992 | Germany | 114/218 |
| 0203277 | 2/1939 | Switzerland | 52/156 |

*Primary Examiner*—Sherman Basinger
*Attorney, Agent, or Firm*—K. S. Cornaby

[57] ABSTRACT

A boat anchoring apparatus according to the invention has an elongate rod with a planar end piece attached at one end thereof for driving vertically into the sand or soil on a beach or waterfront. The rod is driven into the beach using a driving device having a weighted closed end with hollow tube for placement over the rod and having an elongate aperture along the length of the tube with a securing pin for attachment to the rod for pulling the rod out of the soil. Attached to the driving device is a pawl actuating mechanism for securing a line from the boat to said pawl when the rod is vertically in the soil and one end of the driving device is slidingly secured over the vertical rod locking at 90 degrees detaining forward tilt of buried rod and maximizing horizontal direction of vector forces.

6 Claims, 5 Drawing Sheets

ANCHORING APPARATUS

BACKGROUND OF THE INVENTION

This invention relates to an apparatus for securing a boat to a shoreline or to a boat dock with other applications such as (1) securing with facile adjustable utility a rope to shoreline environmental clean-up nets or other apparatus and (2) producing a pull point for all earth anchoring uses such as that needed by four wheel drive vehicles.

Since time immemorial, boaters have been faced with the challenge of securing or anchoring a boat in place off a shoreline. In deep water, a boat can drop one or more deep water anchors and remain in place. However, for many needs, it is desirable to anchor on a beach or shoreline to afford the occupants of the secured water craft easy access to the shore. Over the years, a number of devices have been manufactured to secure boats to an adjacent shore. In most cases, these devices have compromised variations on a theme of driving a metal rod into the sandy beach and securing a line from the boat to the rod, many such rods being impossible to remove which presents an environmental hazard.

In calm waters, such an approach may serve its purpose. The boat can be secured to multiple rods or stakes on both sides of the boat, and the boat may remain in place. However, in windy weather or storm squalls, the boat tends to act as a sail and is moved about. The constant tugging and movement of the lines securing the boat tend to pull the rod or stake out of the sand, causing the boat to break loose.

Attempts to address the stormy water problem have included angling the rod away from the boat at an angle of less than 90 degrees with the far side of the beach. Other attempts have included digging holes and burying large, sometimes heavy, metal anchors. While these heavy anchors tend to be more secure than the simple rod, they are cumbersome to transport and time-consuming to bury and then dig back up when moving the boat or anchored material.

It is an objective of this invention to provide a means of quickly and easily securing a boat, skimmer, netting device or object to a beach with the ability to withstand large torque forces on the line caused by wind and choppy waters with the added benefit of rapidly adjusting rope tension without tying or untying hots.

It is also an objective of this invention to provide a means to safely, quickly and efficiently remove the anchoring apparatus without time consuming, laborious effort.

SUMMARY OF THE INVENTION

According to the invention an anchoring apparatus is provided which has in combination an elongate rod having a flat planar surface member attached to one end of the rod for driving vertically into the shore. A second member is an alternate elongate rod without a planar surface for driving into rocky soil conditions. A third member is an elongate hollow tube driving device (which is sealed by a weighted mass at one end thereof) for disposing over the rod to drive the rod vertically into the beach. The driving device also has slot means and a securing pin to secure the driving device to the rod through an aperture in the rod, thereby enabling the driving device to be employed as a driving means for removing the rod from the beach by pulling up on the driving device against the securing pin lodged in the rod aperture.

The driving device also has a pawl actuating mechanism attached to the elongate tube for securing a line from the boat in a predetermined position in the pawl actuating mechanism thus securing the boat without tying knots which allows the line immediate adjustment.

The driving device also has means at one end thereof for slidingly securing the device perpendicularly along the rod when the rod is in place in the sand to permit the driving device attached to elongate tube with pawl actuating mechanism to rest on the surface of the sand perpendicular to the vertical rod. This locks the vertical rod with planar surface in such a manner that it cannot tilt forward. Vector forces are thus maintained in the horizontal plane pulling against the shore thus forestalling vertical forces that would pull the buried rod out of the soil.

At this position the boat may be secured to the pawl actuating mechanism without tying knots. Lines or ropes may be tightened or loosened immediately without fear of slippage.

For removal of the apparatus from the beach, the boat line is disengaged from the pawl mechanism, and the driving device is slid upwardly and off the rod which was chosen to accommodate soil conditions. The driving device is then lowered over the rod by placing the hollow tube over the rod. The securing pin is placed through the slot in the hollow tube and into the aperture in the rod. Through repeated upward movement of the driving device against the securing pin, the rod is dislodged and can be removed from the beach.

The carrying handle serves two functions: (1) It acts as the fulcrum point as it rests on the beach holding the rope reel and pawl up and out of the sand. (2) It is a safe means of carrying the balanced anchor comfortably before or after use.

The advantage of easy, rapid installation and removal of the anchoring apparatus is made possible by using the kinetic energy of the hammering device.

These and other objects of the invention are to provide a novel way of securing ropes; an effective way of installing combined with a novel Way of removing the anchoring apparatus which is unique in it's ability to inhibit the pull of upward vector forces through the design of the locking mechanism which directs the pull of vector forces to the horizontal plane.

THE DRAWINGS

A preferred embodiment of the invention is illustrated in the accompanying drawings, in which.

DETAILED DESCRIPTION OF THE PREFERRED EMBODIMENTS

Figure 1:
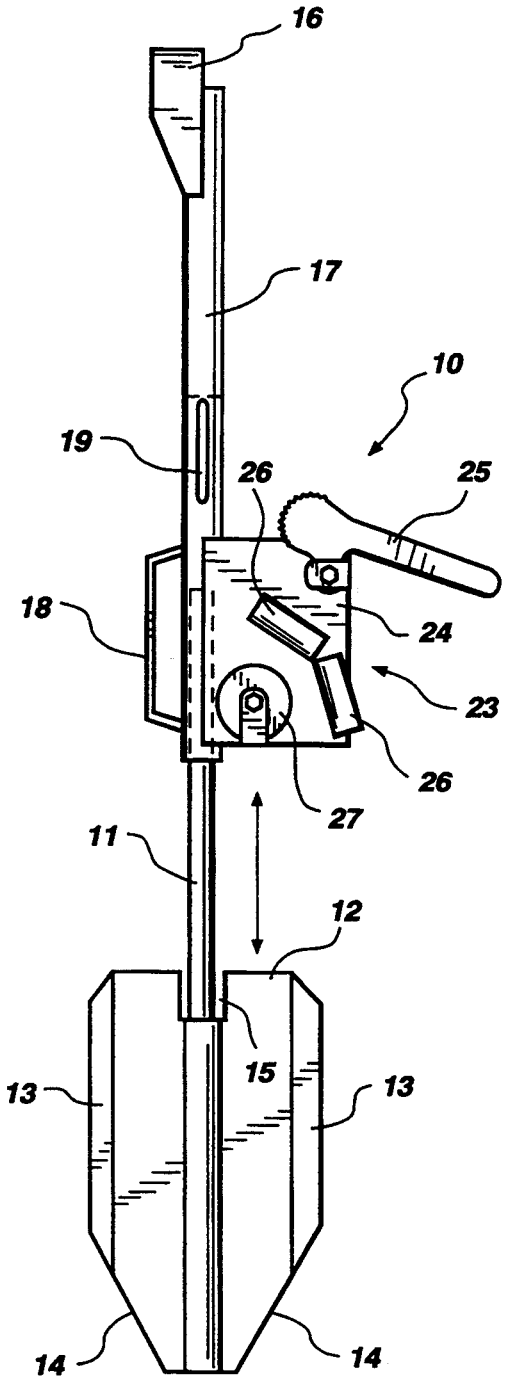
FIG. 1 is a side elevational view of the apparatus showing the driving device in the downward driving position.
Figure 2:
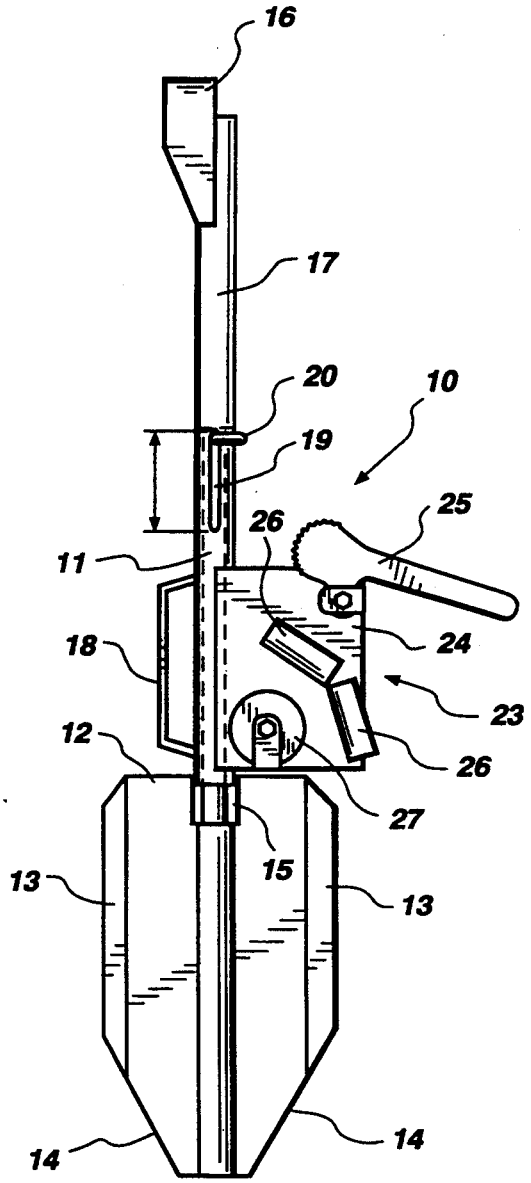
FIG. 2 is a side elevational view of the apparatus shown in FIG. 1, with the driving device in the upward removal position.
Figure 3:
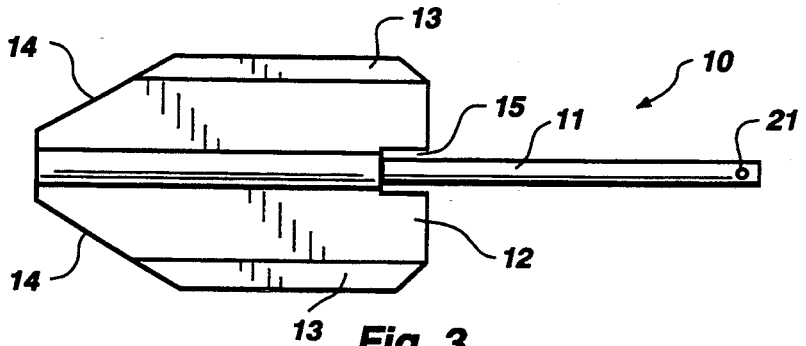
FIG. 3 is a side elevational view of the rod and planar surface member.
Figure 8:
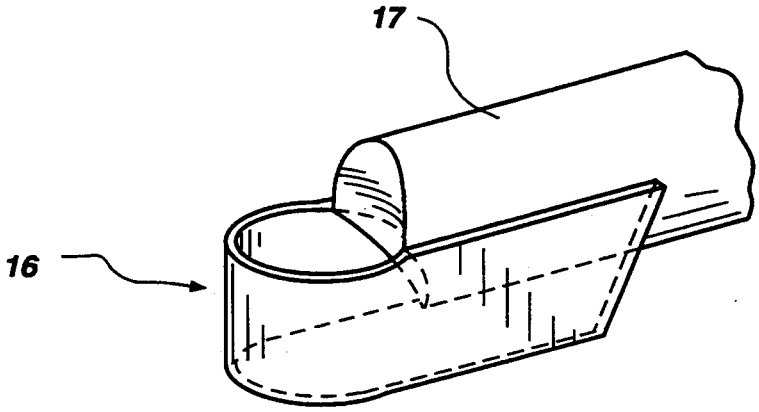
FIG. 8 is a sectional view of the slidable securing means for slidably securing the driving device with pawl actuating mechanism to the rod into its locked horizontal position 90 degrees from the rod.

As shown in FIGS. 1 and 2, a boat securing apparatus of the invention 10 has a rod 11 preferably of metal construction for securing vertically in the sand or dirt of a beach or shoreline (not shown). Rod 11 has secured to the lower end thereof a flat planar surface member 12 for burying below the surface of the beach. Planar member 12 preferably has a pair of laterally forwardly extending securing wings 13 extending respectively along each lateral side of planar member 12 for aiding in retaining planar member 12 securely in the beach when apparatus 10 is in place on the beach. In the preferred embodiment shown in FIGS. 1 and 2, planar member 12 also has a frusta tapered lower edge 14 for use in driving planar member 12 into the beach. Planar member 12 has a notch 15 at the upper end thereof for accommodating the slidable securing retainer 16 shown in FIG. 8, which is disposed at one end of a driving device 17 used for driving rod 11 and planar member 12 into the sand of a beach.

Driving device 17 is a hollow tube preferably of metal construction which is closed with a weighted mass at the upper end with securing retainer 16 attached and is employed by sliding the hollow tube over rod 11 for driving rod 11 into the ground. A handle 18 is provided to aid in transporting the device 10 before or after anchoring use. Driving device 17 can also be used to pull rod 11 out of the beach by using a combination slot 19 in the hollow tube and a securing pin 20 for placement through slot 19 and into an aperture 21 in rod 11. Driving device 17 is then pulled upwardly against securing pin 20 to driving rod 11 upwardly out of the sand.

As illustrated in FIGS. 1, 2, 5, 6 and 7, the means for securing a line 22 from a boat (not shown) to the boat securing apparatus 10 is a pawl actuating mechanism 23 which has a base plate 24 secured to driving device 17. A pawl 25 with one or more teeth, and boat line guide 26 against which pawl 25 can be lodged to secure boat line 22 in a predetermined position, are mounted on base plate 24. A roller 27 is movingly secured to base plate 24 to aid in moving boat line 22 in and out of the pawl actuating mechanism 23.

Figure 5:
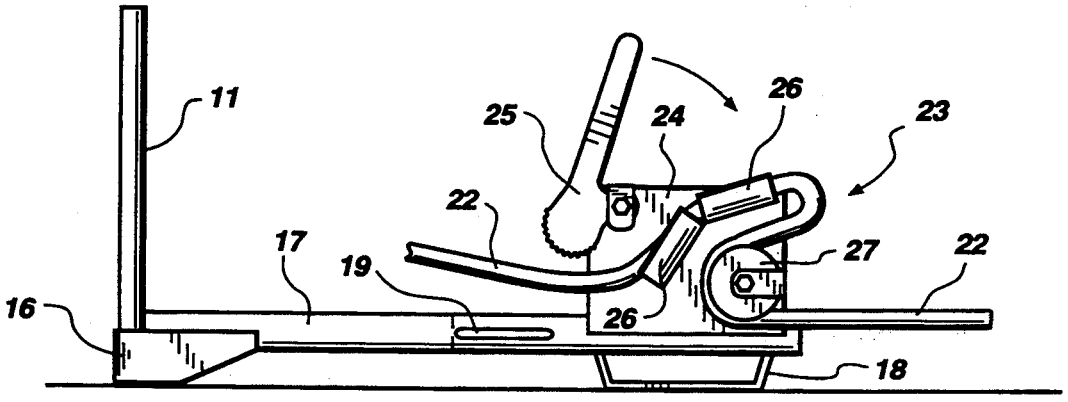
FIG. 5 is a side elevational view of the pawl actuating mechanism in place on the rod with the pawl open and the boat line in place.
Figure 6:
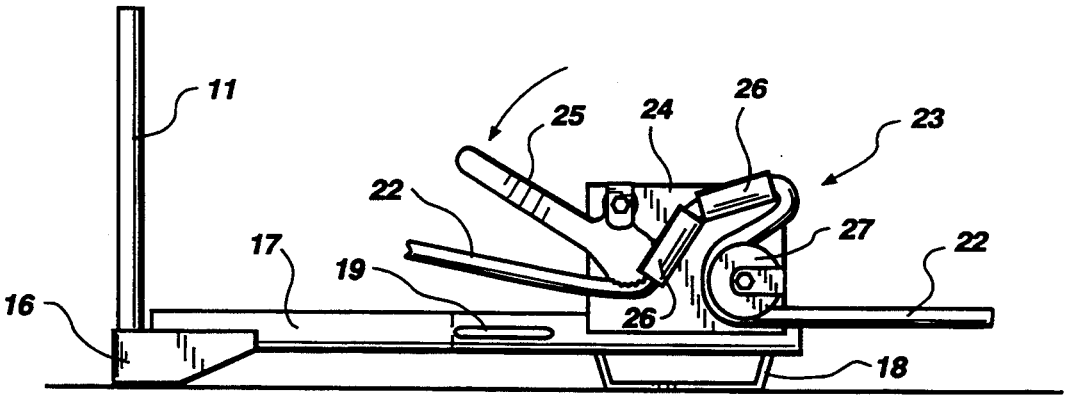
FIG. 6 is a side elevational view of the pawl actuating mechanism shown in FIG. 5, with the pawl mechanism closed to secure the boat line.
Figure 7:
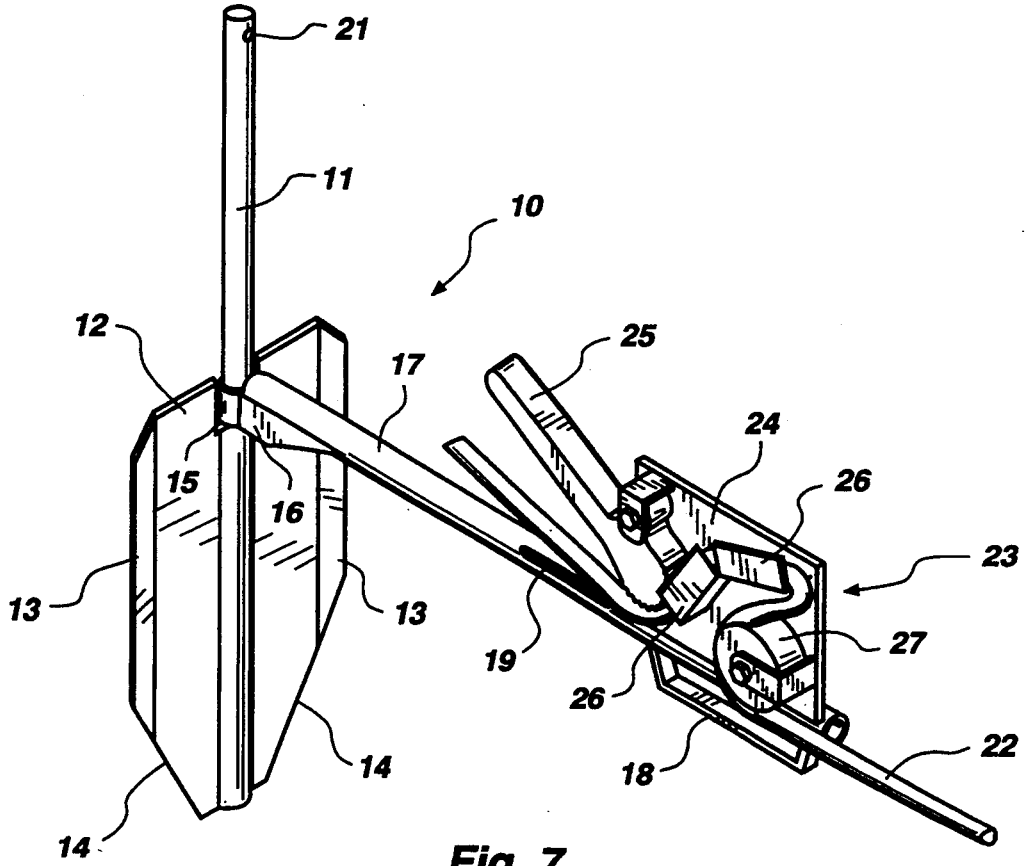
FIG. 7 is a view of the pawl actuating mechanism shown in FIG. 6, with the rod and planar surface member out of the beach.

As shown in FIGS. 5–7, the apparatus 10 in use has the rod 11 vertically in place in the beach. Driving device 17 is perpendicularly:mounted on rod 11 by means of slidable securing retainer 16, so that driving device 17 is locked perpendicular to vertical rod 11. Boat line 22 is secured in pawl actuating mechanism 23 in a taut relationship to the boat and the apparatus 10. In this position vertical rod 11 and perpendicular tube 17 operate to hold rod 11 in place in the beach, even when large vector forces are pulling on boat line 22, such as from wind and wave action against the boat or other such anchored craft or material.

Figure 4:
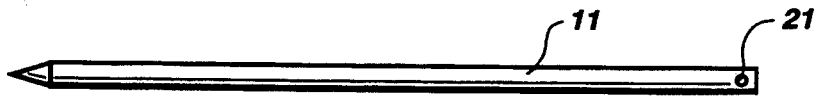
FIG. 4 is a side elevational view of an alternative rod without the planar surface member shown in FIG. 3.

In another preferred embodiment, it may be desirable or necessary to utilize a rod 11 without planar surface member 12, as shown in FIG. 4. For example, if the apparatus 10 is to be employed in rocky soil, it may be impossible to use the planar surface member to drive into the rocky surface. A single rod 11 with aperture 21 to assist with removal can be used in such a situation.

Figure 10:
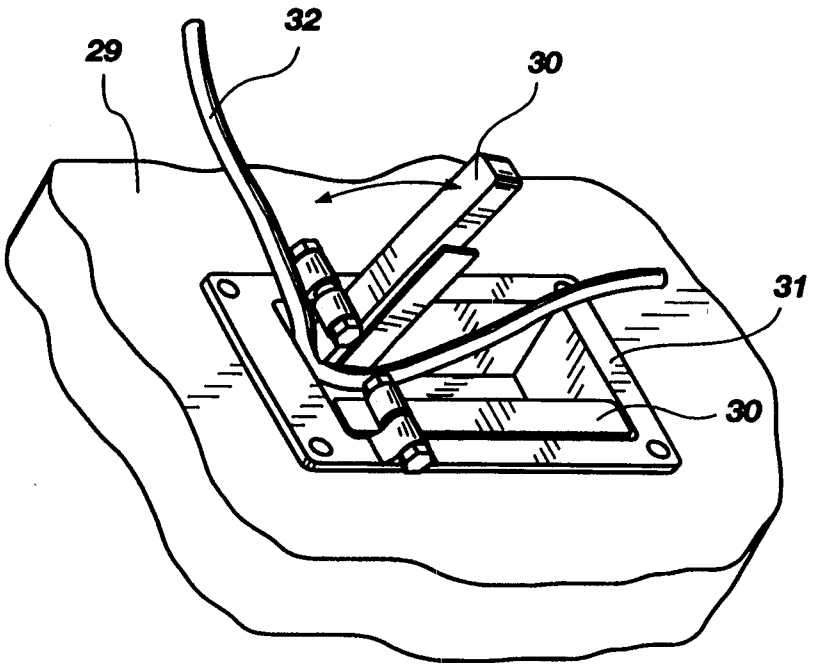
FIG. 10 is a perspective view of the alternative construction shown in FIG. 9, with a boat line in place and one of the securing pawls open.
Figure 9:
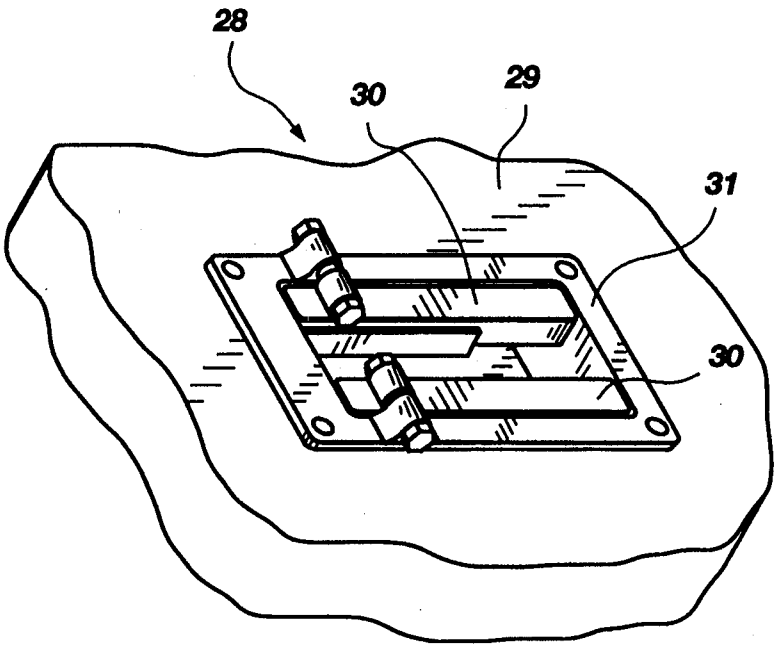
FIG. 9 is a perspective view of an alternative construction for securing a boat line, here shown in a boat dock.
Figure 11:
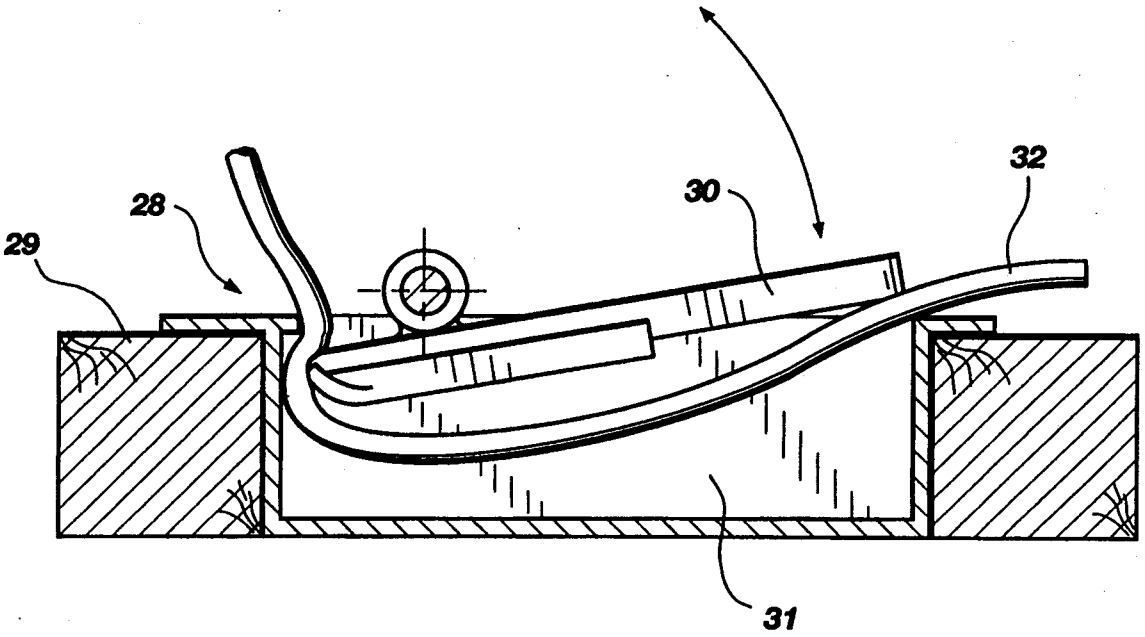
FIG. 11 is a side elevational section of the pawl actuating mechanism shown in FIG. 10.

In another preferred embodiment of the invention as shown in FIGS. 9-11, a pawl actuating mechanism 28 is mounted on a boat dock on a horizontal surface, such as a dock deck 29 or the like. Pawl actuating mechanism 28 in this embodiment has a pair of pawls 30 mounted in a recessed housing 31 in decking 29 to enable lines from two boats to be held at the same time if desired. Boat line 32 is secured using pawl 30 in a similar fashion to the first embodiment shown in FIGS. 5 and 6.

While this invention has been described and illustrated herein with respect to preferred embodiments, it is understood that alternative embodiments and substantial equivalents are included within the scope of the invention as defined by the appended claims.

I claim:

1. An anchoring apparatus comprising in combination:

an elongate inflexible rod having a securing aperture along the length thereof for vertical removal from the soil;

a driving device having a hollow elongate tube, closed at one end for driving said rod into the soil; and having an elongate aperture and securing pin for attachment through the aperture into the securing aperture in said rod; and having also means for slidingly securing one end of the hollow tube to said rod, locking so as to maintain a locked relationship to said rod; and a pawl actuating mechanism attached to said driving device for securing a line from a boat to said driving device when said driving device is perpendicularly attached to said rod.

2. An anchoring apparatus as set forth in claim 1, including a planar member attached to one end of said rod.

3. An anchoring apparatus as set forth in claim 2, wherein said planar member has a pair of offset wing members extending respectively from both sides of said planar member.

4. An anchoring apparatus as set forth in claim 2, wherein said planar member has an offset securing member to accept the placement of said securing means at one end of said driving device.

5. An anchoring apparatus as set forth in claim 1 wherein said elongated tube closed at one end can slide easily at an angle of less than 90 degrees over said partially buried inflexible rod meeting the ground locking both vertical rod and hammering device together securely, detaining forward tilt of the partially buried rod thus maintaining horizontal pull of vector force.

6. An anchoring apparatus as set forth in claim 1, wherein said pawl actuating mechanism has a base plate attached to the hollow tube of said driving device and has a pawl and pawl anchoring members attached thereto for securing a line in said pawl actuating mechanism.

* * * * *